US010071415B1

(12) United States Patent
Trenary

(10) Patent No.: US 10,071,415 B1
(45) Date of Patent: Sep. 11, 2018

(54) ERGONOMIC BUCKING BAR

(71) Applicant: Gulfstream Aerospace Corporation, Savannah, GA (US)

(72) Inventor: Jerry L. Trenary, Savannah, GA (US)

(73) Assignee: Gulfstream Aerospace Corporation, Savannah, GA (US)

( * ) Notice: Subject to any disclaimer, the term of this patent is extended or adjusted under 35 U.S.C. 154(b) by 0 days.

(21) Appl. No.: 15/628,587

(22) Filed: Jun. 20, 2017

(51) Int. Cl.
*B21B 25/00* (2006.01)
*B21J 15/38* (2006.01)
*B25G 1/01* (2006.01)

(52) U.S. Cl.
CPC ..... *B21J 15/383* (2013.01); *B25G 1/01* (2013.01)

(58) Field of Classification Search
CPC ..... B21J 15/383; B25G 1/01; B21B 25/00
USPC ..... 72/466
See application file for complete search history.

(56) References Cited

U.S. PATENT DOCUMENTS 1,414,095 A * 4/1922 Power ..... B21J 15/36 72/479
2,417,490 A * 3/1947 Ellicott ..... B21J 15/36 72/466.4
2,518,073 A * 8/1950 Sargent ..... B21D 1/06 72/466.6
3,585,838 A * 6/1971 Newlon ..... B21J 15/10 72/466.5
3,898,835 A * 8/1975 Winter ..... B21J 15/38 29/243.53
5,497,648 A * 3/1996 Crossman ..... B21D 1/06 72/466.6
5,875,674 A * 3/1999 Ayers, Jr. ..... B21J 15/36 72/476

* cited by examiner

*Primary Examiner* — David B Jones
(74) *Attorney, Agent, or Firm* — LKGlobal | Lorenz Kopf, LLP

(57) ABSTRACT

An ergonomic bucking bar is disclosed herein. The ergonomic bucking bar includes a bar body having a proximal end and a distal end. The proximal end includes a plurality of apertures formed therein for reducing weight of the bar body at the proximal end. The ergonomic bucking bar includes a compliant hand grip positioned over the proximal end of the bar body for reducing vibrations transmitted through the bar body during a riveting operation using the bucking bar. Optionally, the distal end includes at least one aperture formed therein for receiving an insert to increase the weight of the bar body at the distal end.

18 Claims, 8 Drawing Sheets

ERGONOMIC BUCKING BAR

TECHNICAL FIELD

The present invention generally relates to bucking bars that are used in connection with riveting operations, and more particularly relates to an ergonomic bucking bar that facilitates riveting operations with reduced operator fatigue.

BACKGROUND

Contemporary business aircraft are assembled using hundreds of thousands of rivets. Generally, riveting is preferred in aircraft construction over welding since welding of aluminum alloys is complex compared to steel welding, and welding may weaken the aluminum material at the weld joint. Moreover, riveted connections are easier to inspect and repair.

In a typical riveting operation, a rivet is installed into an opening through two or more pieces of material to be joined together. As will be appreciated by those skilled in the art, the rivet size, shank length and type of rivet (e.g., flush or button-head rivets) are selected by the technician depending upon the joint to be formed. A bucking bar is placed against the shank of the rivet and a riveting gun (or a hammer) is used on the head of the rivet thereby transmitting energy that deforms the shank and secures the joint.

Conventional bucking bars are typically made of solid steel and shaped in various ways to facilitate placement of the bucking bar against the rivet shank (e.g., to get around obstacles or riveting on a curved surface). Bucking bars can be heavy for the technician to hold in place and they transmit repeated vibrations from the high-impact riveting operation to the operator's hand. This leads to discomfort and fatigue for the technician who must repeatedly preform riveting operations during the assembly of an aircraft.

Accordingly, it is desirable to provide an ergonomic bucking bar. It is further desirable that the ergonomic bucking bar having reduced weight and transmit fewer vibrations than conventional bucking bars. Furthermore, other desirable features and characteristics will become apparent from the subsequent detailed description and the appended claims, taken in conjunction with the accompanying drawings and the foregoing technical field and background.

BRIEF SUMMARY

Exemplary embodiments of an ergonomic bucking bar are disclosed herein. In a first non-limiting embodiment, an ergonomic bucking bar includes a bar body having a proximal end and a distal end. The ergonomic bucking bar includes, but is not limited to, the proximal end having a plurality of apertures formed therein for reducing weight of the bar body at the proximal end. The ergonomic bucking bar includes, but is not limited to, a compliant hand grip positioned over the proximal end of the bar body for reducing vibrations transmitted through the bar body during a riveting operation using the bucking bar.

In a second non-limiting embodiment, an ergonomic bucking bar includes a bar body having a proximal end and a distal end. The ergonomic bucking bar includes, but is not limited to, one or more apertures formed in the distal end for receiving an insert to increase the weight or mass of the bar body at the distal end. The ergonomic bucking bar includes, but is not limited to, a compliant hand grip positioned over the proximal end of the bar body for reducing vibrations transmitted through the bar body during a riveting operation using the bucking bar.

In a third non-limiting embodiment, a method is provided for forming an ergonomic bucking bar. The method includes, but is not limited to, forming a plurality of apertures in a proximal end of a bar body to reduce weight of the bar body at the proximal end, and positioning a compliant hand grip over the proximal end of the bar body to form the bucking bar.

In a forth non-limiting embodiment, a method is provided for forming an ergonomic bucking bar. The method includes, but is not limited to, forming at least one insert to increase weight of the bar body at the distal end, and positioning a compliant hand grip over the proximal end of the bar body to form the bucking bar.

In a fifth non-limiting embodiment, a non-transitory computer-readable medium for producing an ergonomic bucking bar comprises instructions that when executed by a processor cause a three-dimensional printer to successively deposit a rigid material to produce a bar body having a plurality of apertures formed in a proximal end of the bar body.

In a sixth non-limiting embodiment, a non-transitory computer-readable medium for producing an ergonomic bucking bar comprises instructions that when executed by a processor cause a three-dimensional printer to successively deposit a rigid material to produce a bar body having at least one aperture formed in a distal end of the bar body to receive an insert to increase weight at the distal end of the ergonomic bucking bar.

BRIEF DESCRIPTION OF THE DRAWINGS

The present invention will hereinafter be described in conjunction with the following drawing figures, wherein like numerals denote like elements.

DETAILED DESCRIPTION

As used herein, the word "exemplary" means "serving as an example, instance, or illustration." The following detailed description is merely exemplary in nature and is not intended to limit application and uses. Any embodiment described herein as "exemplary" is not necessarily to be construed as preferred or advantageous over other embodiments. All of the embodiments described in this Detailed Description are exemplary embodiments provided to enable persons skilled in the art to make or use the embodiment and not to limit the scope that is defined by the claims. Furthermore, there is no intention to be bound by any expressed or implied theory presented in the preceding Technical Field, Background, Drawings Summary or the following Detailed Description.

An ergonomic bucking bar for use in riveting operations is described herein. The ergonomic bucking bar of the present disclosure has a proximal (handle) end and a distal (working) end. To reduce weight in the proximal (handle) end, a plurality of apertures are formed in the proximal end and extend into the bar body. To reduce transmitted vibrations during a riveting operation, a compliant (e.g., rubber-like) handgrip may be placed over the proximal end. In some embodiments, the weight or mass of the distal (working) end may be increased by forming at least one aperture in the distal end and placing an insert having a higher density than the material of the bucking bar into the aperture. While the ergonomic bucking bar of the present disclosure is described as affording an advantage in an aircraft assembly application, it will be appreciated that the present disclosure may be advantageously employed in other applications, including but not limited to, riveting operations for ground based vehicles, watercraft and spacecraft without departing from the teachings of the present disclosure. Furthermore, use of the ergonomic bucking bar of the present disclosure is not limited to use in the assembly of vehicles, but rather may be employed in any assembly process that entails riveting operations.

A greater understanding of the ergonomic bucking bar described above may be obtained through a review of the illustrations accompanying this application together with a review of the Detailed Description that follows.

Figure 1:
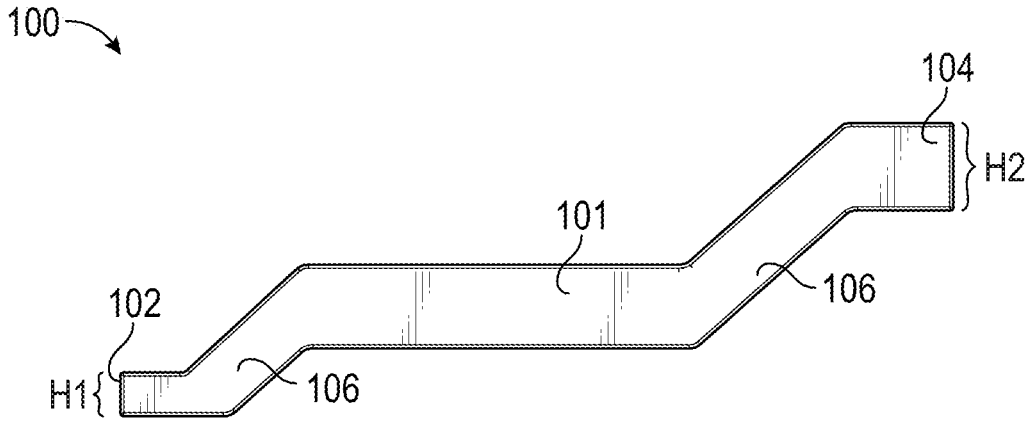
FIG. 1 (Prior Art)
FIG. 1 is a side view illustrating a conventional bucking bar.

FIG. 1 is a side view illustrating a conventional bucking bar 100. The conventional bucking bar 100 has a bar body 101 having a proximal end 102 and a distal end 104 and may be formed with angular sections 106 along the bar body 101. In the conventional bucking bar of FIG. 1, either the proximal end 102 or the distal end 104 may be the working end with the proximal end 102 having a different thickness (H1) than the distal end 104 (H2). Typically, the conventional bucking bar 100 of FIG. 1 is made of solid iron or steel, and accordingly, can be quite heavy for a technician to hold in place during repeated riveting operations over a long period of time. Additionally, being made of solid steel vibrational energy from the riveting gun is transmitted through the conventional bucking bar 100 into the hand of the technician holding the bucking bar during the riveting operations.

Figure 2:
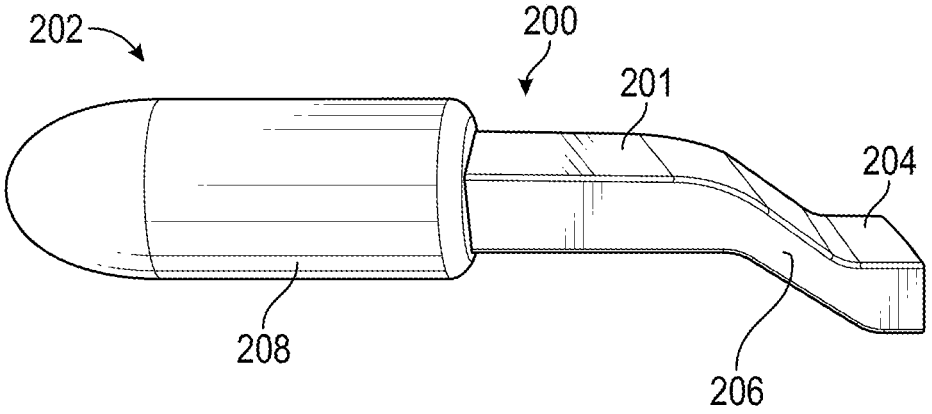
FIG. 2 is a side view illustrating a non-limiting embodiment of an ergonomic bucking bar in accordance with the teachings of the present disclosure.

Referring now to FIG. 2, a side view illustrating a non-limiting embodiment of an ergonomic bucking bar 200 is shown. The ergonomic bucking bar 200 has a bar body 201 having a proximal (handle) end 202 in a distal (working) end 204. The proximal (handle) end 202 is inserted into a rubber-like handgrip 208 that facilitates handling by the technician and absorbs some of the vibrations transmitted along the ergonomic bucking bar 200. Those skilled in the art will appreciate that the ergonomic bucking bar 200 can be formed in a variety of shapes and sizes, and in some embodiments, includes an angular portion 206 along the bar body 201. In one non-limiting embodiment, the ergonomic bucking bar 200 is formed by three-dimensional printing such as by depositing and melting maraging steel (MS1) on a direct metal laser sintering (DMLS) machine. Similarly, the handgrip 208 may be formed using three-dimensional printing by depositing an ultraviolet cured rubber-like material.

Figure 3:
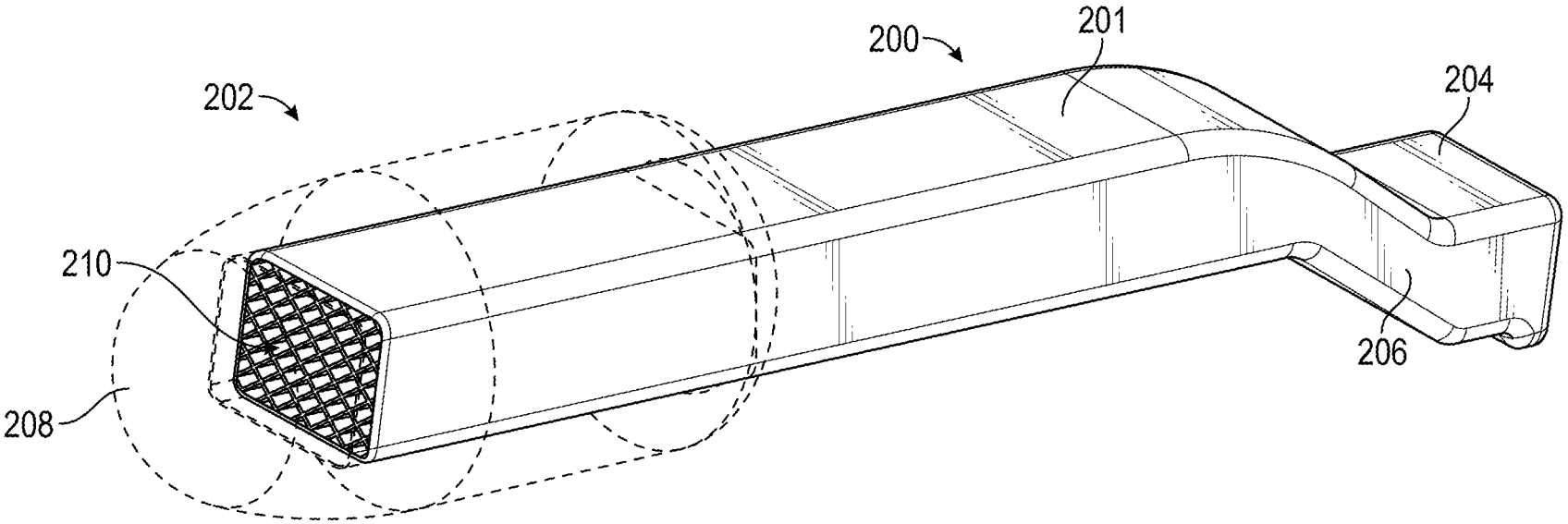
FIG. 3 is a perspective, partially transparent view of the ergonomic bucking bar of FIG. 2 in accordance with the teachings of the present disclosure.
Figure 4:
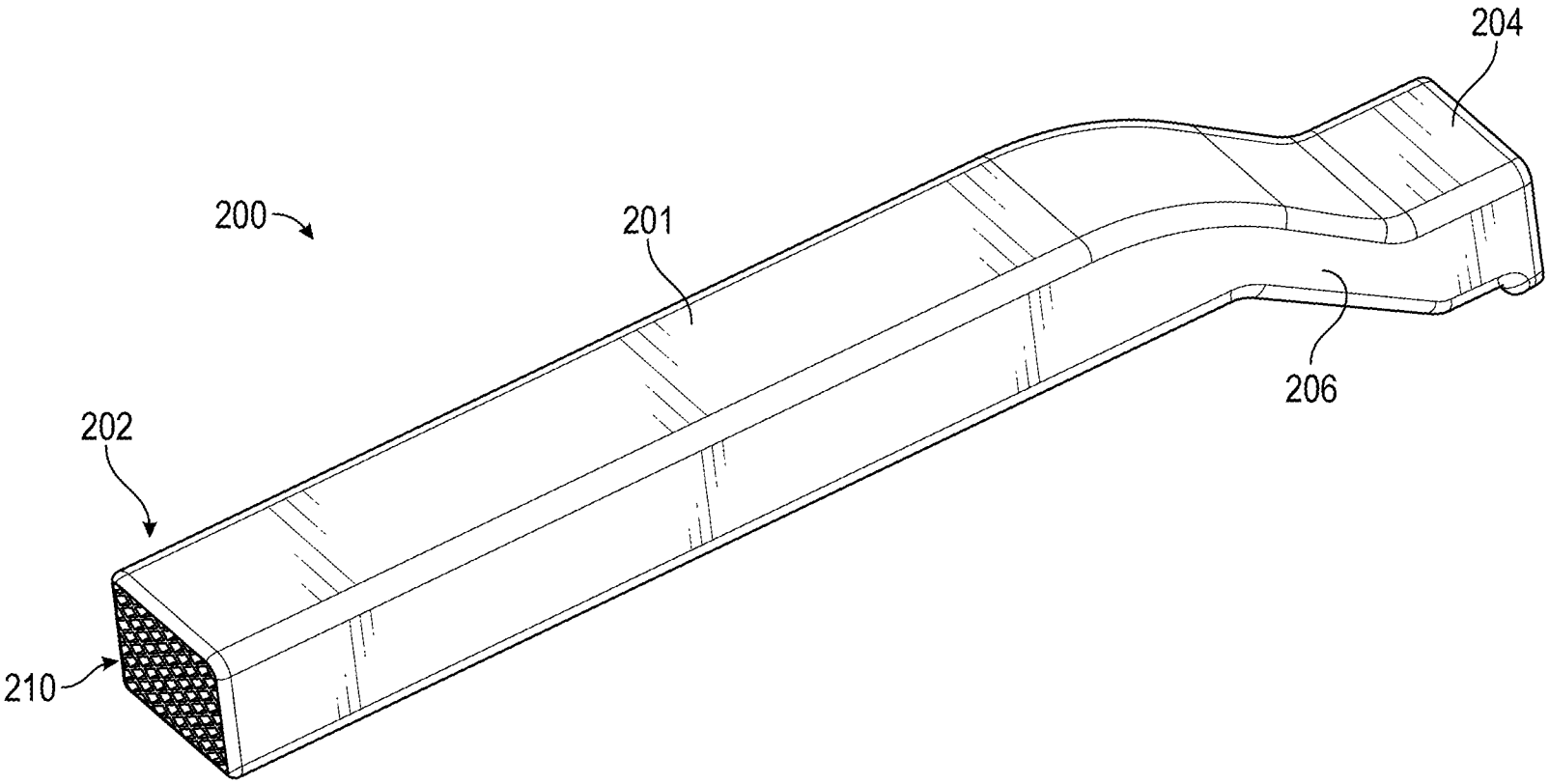
FIG. 4 is a perspective view of the ergonomic bucking bar of FIG. 2 in accordance with the teachings of the present disclosure.
Figure 5:
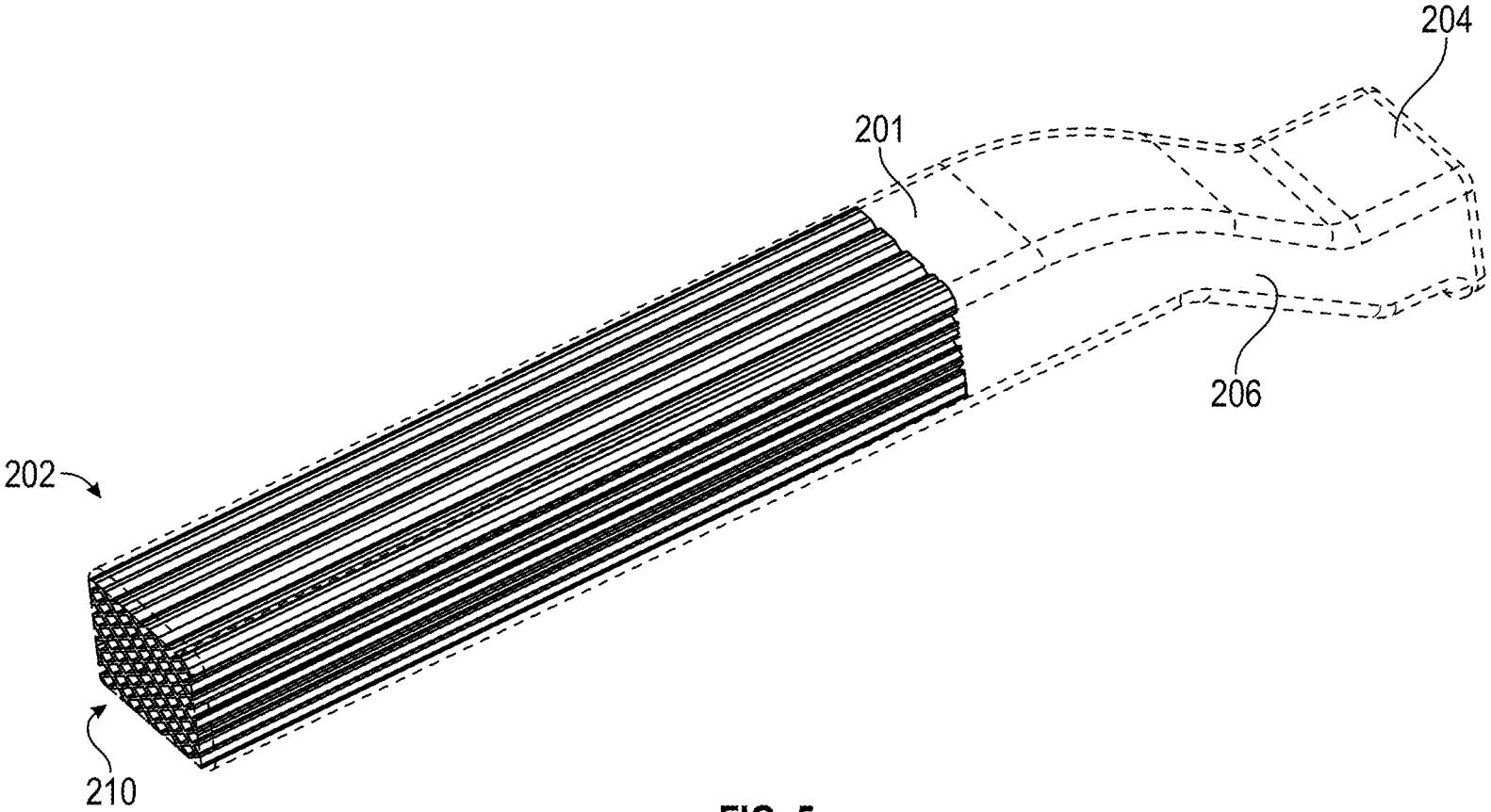
FIG. 5 is a perspective, transparent view of the ergonomic bucking bar of FIG. 2 in accordance with the teachings of the present disclosure.
Figure 6:
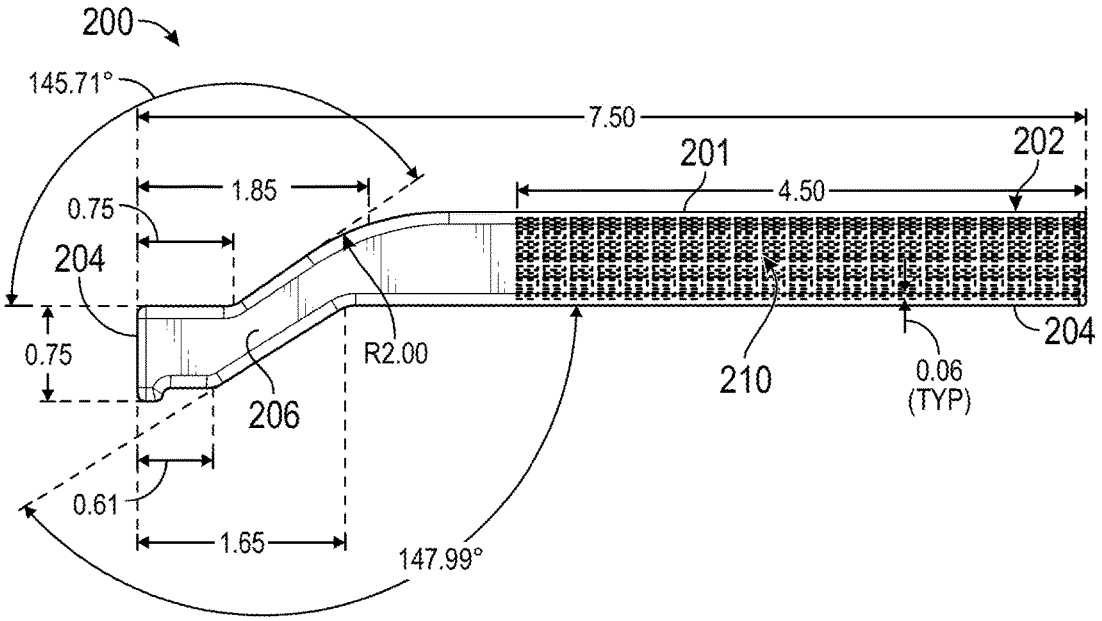
FIG. 6 is a schematic diagram illustrating the ergonomic bucking bar of FIG. 2 in accordance with the teachings of the present disclosure.

With continued reference to FIG. 2, FIGS. 3-5, provide other views illustrating a non-limiting embodiment of the ergonomic bucking bar 200 of the present disclosure. These various perspective views provide further illustration of the ergonomic features of the ergonomic bucking bar 200. In FIG. 3, the handgrip 208 is shown transparent revealing a plurality of apertures 210 formed into the proximal end and extending into the bar body 201 to reduce weight. In accordance with any particular implementation, the number and size of the apertures 210 may vary and the length along the bar body 201 to which the apertures 210 extend may change to reduce the proximal (handle) weight as desired. FIG. 4 illustrates the ergonomic bucking bar 200 without the handgrip 208. In some embodiments, the plurality of apertures 210 may be formed by a drilling operation (see FIG. 10) on a bucking bar body of solid material to remove weight in the proximal (handle) end 202. As noted above, in other embodiments the ergonomic bucking bar 200 can be formed by three-dimensional printing and the apertures 210 formed during the three-dimensional printing process (see, FIG. 11). FIG. 5 illustrates a non-limiting example of the ergonomic bucking bar 200 transparent showing the plurality of apertures 210 extending substantially along the length of the bar body 201. This allows the distal (working) end 204 to remain solid material so that vibrational energy from the riveting gun can be used against the bucking bar to deform the shank of the rivet.

With continued reference to FIGS. 2-5, FIG. 6 is a schematic diagram of the ergonomic bucking bar 200 providing an example of non-limiting dimensions suitable for one exemplary embodiment.

Figure 7:
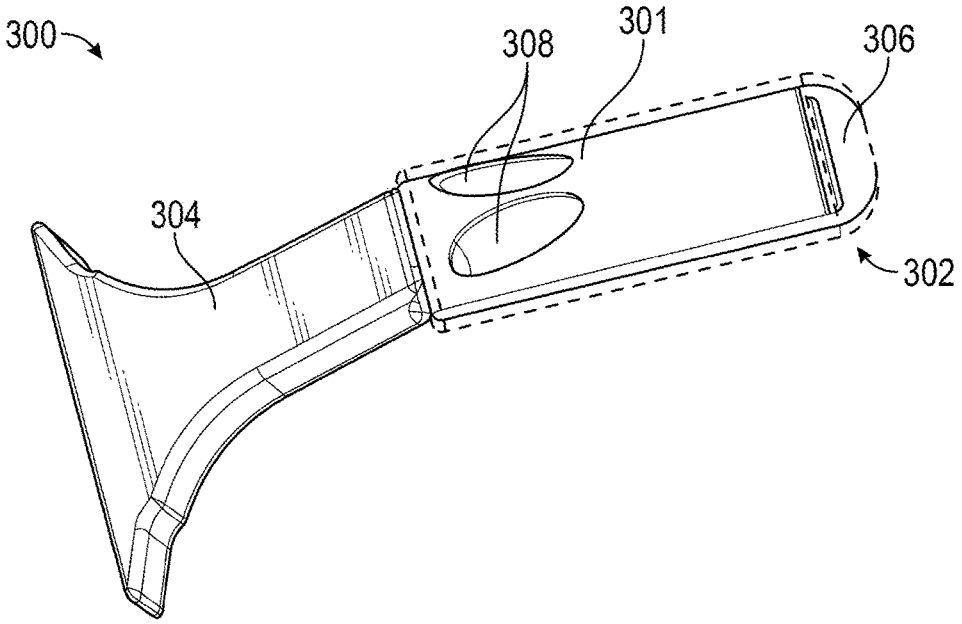
FIG. 7 is a perspective view illustrating another non-limiting embodiment of the ergonomic bucking bar in accordance with the teachings of the present disclosure.
Figure 8:
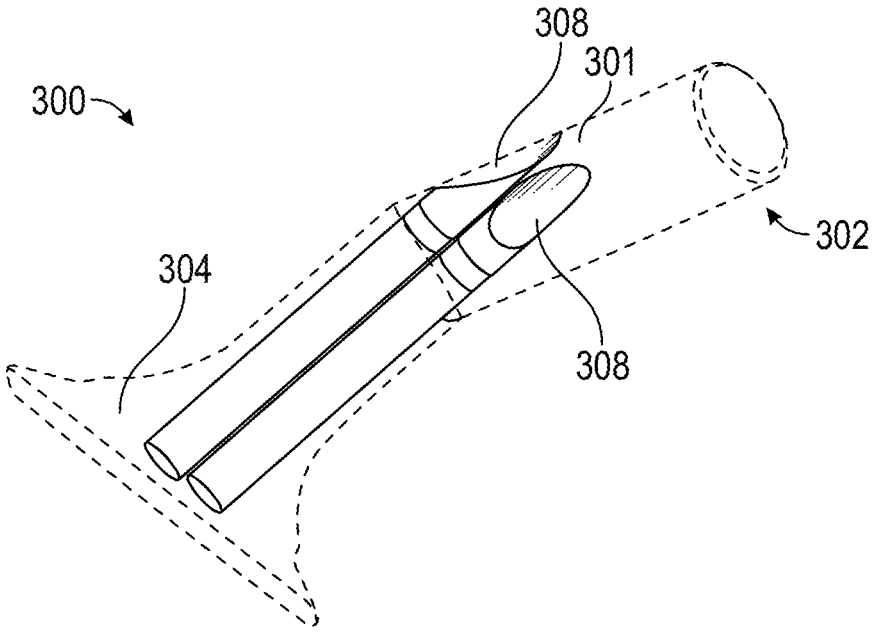
FIG. 8 is a perspective, transparent view of the ergonomic bucking bar of FIG. 7 in accordance with the teachings of the present disclosure.
Figure 9:
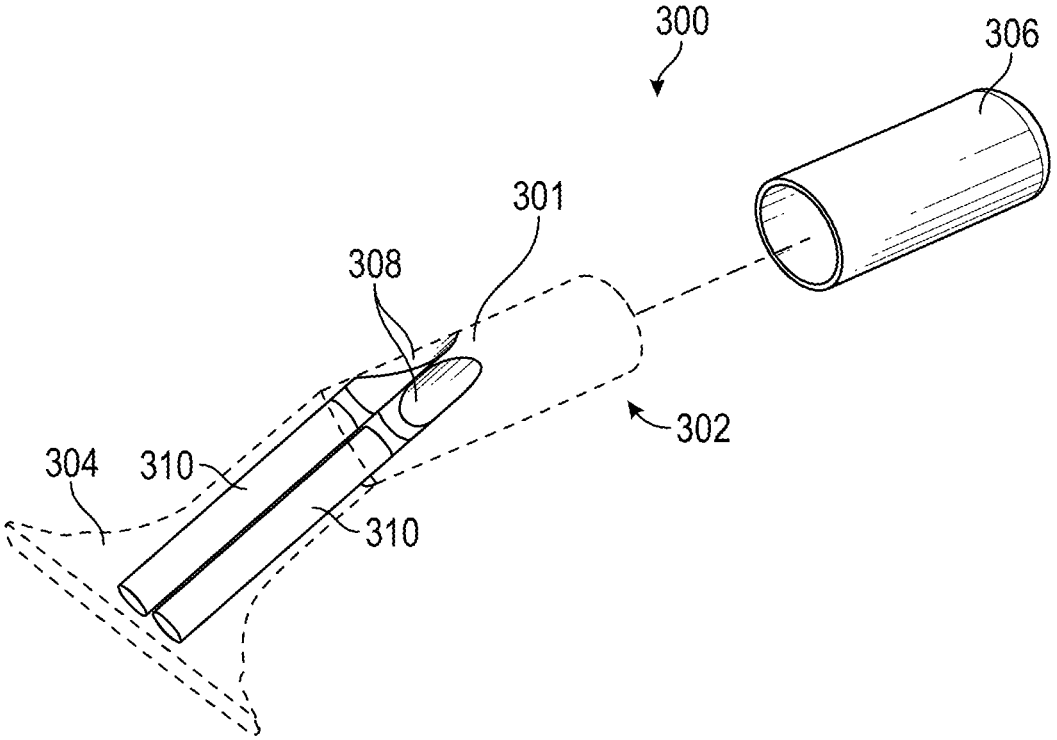
FIG. 9 is a perspective exploded view of the ergonomic bucking bar of FIG. 7 in accordance with the teachings of the present disclosure.

FIGS. 7-9 present perspective views illustrating another non-limiting embodiment of the ergonomic bucking bar 300 according to the teachings of the present disclosure. The ergonomic bucking bar 300 has a bar body 301 that includes a proximal (handle) end 302 and a distal (working) end, the distal end having formed therein at least one aperture 308. The aperture(s) 308 may be formed by drilling or may be formed during a three-dimensional printing operation and are sized to receive inserts made of a material of higher density than the surrounding steel of the distal end 304. This operates to increase the weight or mass of the distal end 304 thereby increasing amplified reflected energy from the riveting gun to more effectively deform the shank of the rivet and secure the joint. In one non-limiting example the distal end 304 of the ergonomic bucking bar 300 is formed of maraging steel (MS1) and the inserts 310 may be formed of carbide or tungsten steel which has a density about twice that of conventional steel. The inserts 310 may be captivated in the apertures 308 by an adhesive or other suitable means. A compliant handgrip 306 can be placed over the proximal end 302 and cover the apertures 308 to reduce vibration during use of the ergonomic bucking bar 300.

Figure 10:
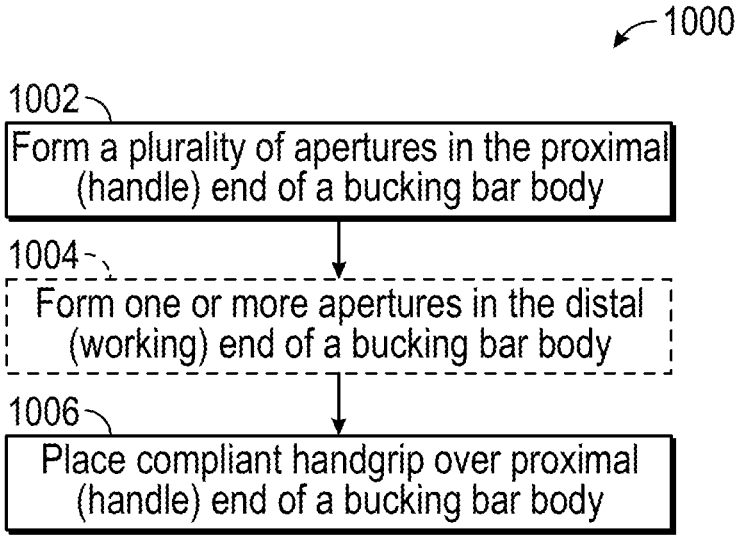
FIG. 10 is a flow diagram illustrating a method in accordance with the teachings of the present disclosure.

As mentioned above, and with continued reference to FIGS. 2-9, the present disclosure contemplates that the ergonomic bucking bar 200/300 may be formed from a solid (cast or machined) bucking bar body via a method 1000 illustrated in FIG. 10. In block 1002, a plurality of apertures are formed in a proximal (handle) end of a bucking bar body. Next, block 1004 optionally also forms one or more apertures in the distal (working) end of the bucking bar body. In one non-limiting embodiment, these forming operations can be done by successive drilling operations. Then, a compliant handgrip can be placed over the proximal end (block 1006) for form the ergonomic bucking bar 200 or 300.

Figure 11:
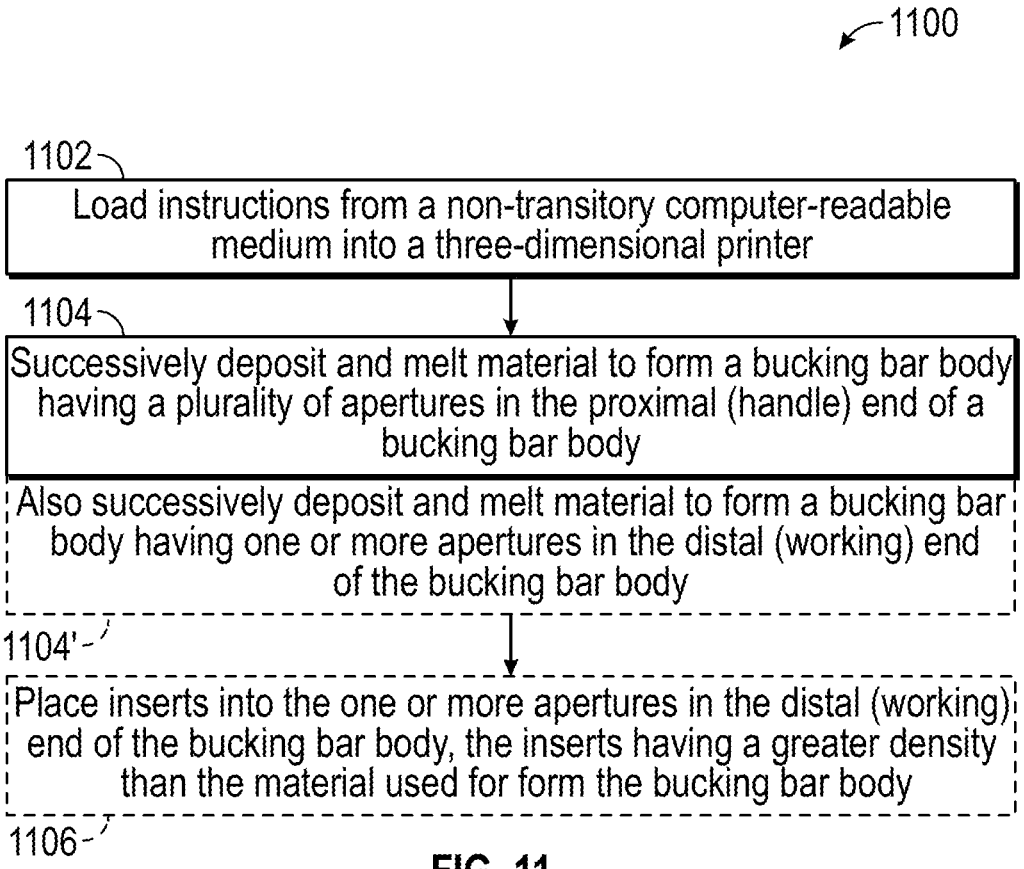
FIG. 11 is a flow diagram illustrating a method in accordance with the teachings of the present disclosure.
Figure 12:
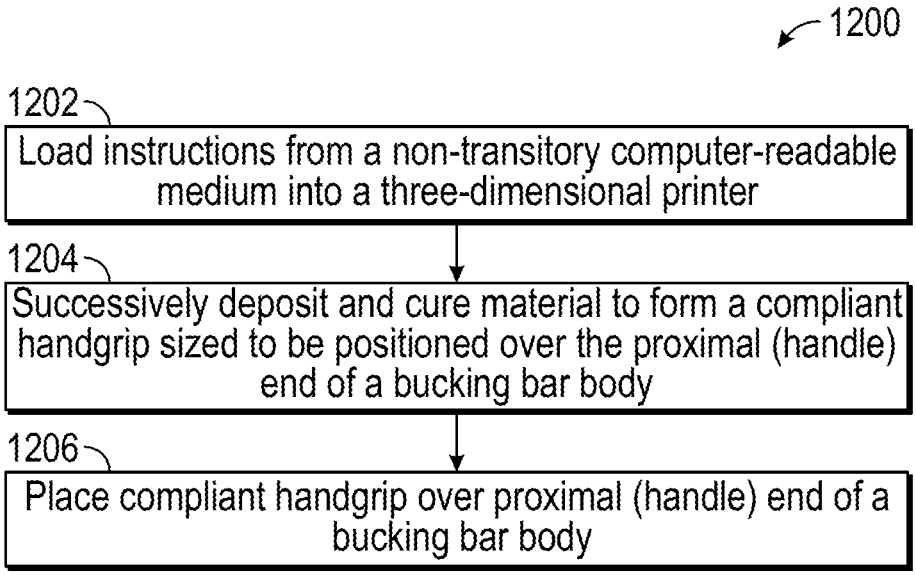
FIG. 12 is a flow diagram illustrating a method in accordance with the teachings of the present disclosure.

Also as mentioned above, and with continued reference to FIGS. 2-9, the present disclosure contemplates that the ergonomic bucking bar 200/300 may be formed by three-dimensional printing. Accordingly, the present disclosure contemplates a non-transitory computer-readable medium that would contain instructions that when executed by a processor would cause a three-dimensional printer to successively deposit material in a way to form the ergonomic bucking bar 200/300 in any particular shape or size desired for any particular application. As a non-limiting example, FIG. 11 illustrates one embodiment 1100 of the present disclosure, where the non-transitory computer-readable medium would contain instructions that when loaded into (block 1102) executed by a processor cause a direct metal laser sintering (DMLS) three-dimensional printer to successively deposit and melt maraging steel (MS1) to form the ergonomic bucking bar 200 with the plurality of apertures 210 formed in the proximal end 202 (block 104) and/or the ergonomic bucking bar 300 having the apertures 308 formed in the distal end (block 1104') to receive inserts 310 (block 1106) as discussed above. As one non-limiting example, this may be done on an EOS M280 DMLS machine. As will be appreciated by those skilled in the art, the bucking bar 200 may also include one or more apertures in the distal end and the bucking bar 300 may include a plurality of apertures in the proximal end. Additionally, as illustrated in FIG. 12, the present disclosure contemplates an exemplary method 1200 in which a non-transitory computer-readable medium would contain instructions that when loaded into executed (block 1202) by a processor would cause a three-dimensional printer to successively deposit an ultraviolet cured rubber-like material (block 1204) in a way to form the compliant handgrip 208 or 306. The 3-D printed complaint handgrip can then be positioned over the proximal (handle) end of the bucking bark body (block 1206). As one non-limiting example, this may be done by depositing POLYJET TANGO BLACK material on an EDEN 350V three-dimensional printer.

It will be appreciated that skilled artisans may form the disclosed ergonomic bucking bark in varying ways for each particular application, but such implementation variations should not be interpreted as causing a departure from the scope as set forth in the claims.

In this document, relational terms such as first and second, and the like may be used solely to distinguish one entity or action from another entity or action without necessarily requiring or implying any actual such relationship or order between such entities or actions. Numerical ordinals such as first, second, third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as connect or coupled to that are used in describing a relationship between different elements does not imply that a direct physical connection must be made between these elements. For example, two elements may be connected to each other physically, electronically, logically, or in any other manner, through one or more additional elements.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the disclosure as set forth in the appended claims.

What is claimed is:

1. A bucking bar, comprising:

a bar body comprised of a first material having a first density and having a proximal end and a distal end, the proximal end having a plurality of apertures formed therein;

a compliant hand grip positioned over the proximal end of the bar body the compliant hand grip having a compliant density different from the first density;

wherein the plurality of apertures reduces weight of the bar body at the proximal end and the compliant hand grip reduces vibrations transmitted from the distal end through the bar body during a riveting operation using the bucking bar.

2. The bucking bar of claim 1, further comprising at least one aperture in the distal end of the bar body for receiving an insert comprising a second material having a second density being greater than the first density.

3. The bucking bar of claim 2, wherein the first material comprises steel and the second material comprises carbide.

4. The bucking bar of claim 2, wherein the first material comprises steel and the second material comprises tungsten steel.

5. The bucking bar of claim 2, wherein the at least one aperture in the distal end is formed during a three-dimensional printing operation forming the bar body.

6. The bucking bar of claim 1, wherein the plurality of apertures in the proximal end are formed during a three-dimensional printing operation forming the bar body.

7. The bucking bar of claim 1, wherein the plurality of apertures in the proximal end of the bar body are formed by drilling.

8. The bucking bar of claim 1, wherein the compliant hand grip is formed via a three-dimensional printing operation.

9. A method of forming a bucking bar, comprising:

forming a plurality of apertures in a proximal end of a bar body during a three-dimensional printing operation forming the bar body to reduce weight of the bar body at the proximal end; and positioning a compliant hand grip over the proximal end of the bar body to form the bucking bar.

10. A method of forming a bucking bar, comprising: forming a plurality of apertures in a proximal end of a bar body via drilling the plurality of apertures in the bar body to reduce weight of the bar body at the proximal end; and positioning a compliant hand grip over the proximal end of the bar body to form the bucking bar.

11. The method of claim 9, further comprising forming the compliant hand grip via a three-dimensional printing process prior to positioning the compliant hand grip over the proximal end of the bar body to form the bucking bar.

12. The method of claim 9, further comprising:

forming at least one aperture in a distal end of the bar body; and placing an insert into the at least one aperture in the distal end of the bar body, the insert having a greater density than a density of the bar body thereby increasing a weight of the bar body at the distal end.

13. The method of claim 12, wherein forming the at least one aperture in the distal end comprises a three-dimensional printing operation forming the bar body.

14. A non-transitory computer-readable medium for producing a bucking bar, the non-transitory computer-readable medium comprising instructions stored thereon, that when executed by a processor, cause a three-dimensional printer to perform the steps of:

successively deposit a rigid material to produce a bar body having a plurality of apertures formed in a proximal end of the bar body.

15. The non-transitory computer-readable medium of claim 14, further comprising instructions stored thereon, that when executed by the processor, cause the three-dimensional printer to perform the step of successively depositing the rigid material to produce the bar body having the plurality of apertures formed in a proximal end of the bar body and at least one aperture in a distal end of the bar body.

16. The non-transitory computer-readable medium of claim 15, further comprising instructions stored thereon, that when executed by the processor, cause the three-dimensional printer to perform the step of successively depositing and melting maraging powdered steel to produce the bar body having the plurality of apertures formed in a proximal end of the bar body and the at least one aperture in a distal end of the bar body.

17. The non-transitory computer-readable medium of claim 14, further comprising instructions stored thereon, that when executed by the processor, cause the three-dimensional printer to perform the step of successively depositing and melting maraging powdered steel to produce the bar body having the plurality of apertures formed in a proximal end of the bar body.

18. The non-transitory computer-readable medium of claim 14, further comprising instructions stored thereon, that when executed by the processor, cause the three-dimensional printer to depositing and melting maraging powdered steel to produce the bar body having the plurality of apertures formed in a proximal end of the bar body and the at least one aperture in a distal end of the bar body with an angular section between the proximal end and the distal end.

* * * * *